United States Patent [19]

Staufner

[11] Patent Number: 4,681,502

[45] Date of Patent: Jul. 21, 1987

[54] CONVEYING APPARATUS FOR THE PROCESSING OF PRINTED ITEMS

[76] Inventor: Helmut Staufner, Alte Schiffahrt 4, 7300 Esslingen-Mettingen, Fed. Rep. of Germany

[21] Appl. No.: 765,369

[22] Filed: Aug. 13, 1985

[30] Foreign Application Priority Data

Aug. 17, 1984 [DE] Fed. Rep. of Germany ..... 3430255
Apr. 26, 1985 [DE] Fed. Rep. of Germany ..... 3515068

[51] Int. Cl.[4] ..... B65G 59/04

[52] U.S. Cl. ..... 414/121; 414/118; 414/416; 414/37; 414/627; 271/9; 271/157; 270/58; 198/705; 198/482.1

[58] Field of Search ..... 271/162, 164, 9, 157, 271/158, 159, 107; 270/58; 414/117, 118, 119, 120, 121, 122, 331, 416, 626, 618, 37, 47, 627; 198/705, 482.1

[56] References Cited

U.S. PATENT DOCUMENTS

| | | | |
|---|---|---|---|
| 1,249,042 | 12/1917 | Dexter et al. | 271/167 X |
| 1,976,892 | 10/1934 | Shomauer | 271/164 X |
| 2,172,519 | 9/1939 | Reeder | 270/58 X |
| 2,752,153 | 6/1956 | Schramm | 271/158 |
| 3,199,863 | 8/1965 | Muller | 414/121 X |
| 3,367,472 | 2/1968 | Rossi | 198/482.1 X |
| 3,383,103 | 5/1968 | Miller | 270/58 |
| 3,445,017 | 5/1969 | Kile | 414/416 |
| 3,890,185 | 6/1975 | Umazume | 414/120 X |
| 4,273,496 | 6/1981 | Papalexis | 198/705 X |
| 4,451,191 | 5/1984 | Torre | 414/120 X |

FOREIGN PATENT DOCUMENTS

| | | | |
|---|---|---|---|
| 2210056 | 9/1973 | Fed. Rep. of Germany | 414/401 |
| 2495121 | 6/1982 | France | 414/121 |

*Primary Examiner*—Frank E. Werner
*Attorney, Agent, or Firm*—McGlew and Tuttle

[57] ABSTRACT

An apparatus for the peel off feeding of stacked printed items such as newspapers, periodicals, booklets or the like, comprises a number of open-topped containers for receiving the stacked items. There is furthermore a peel off station into which the containers are moved for the removal of the printed items therein. Each such container for printed items has a bottom shelf with device for guiding it vertically and is slanted towards a removal side, at least in the feeding station. At least during the time it is in the peel off station the shelf in each container may be driven vertically so as to bring the uppermost printed item therein into the range of action of a suction device which cooperates with a scoop plate in lifting and sliding off the items from the top of the container one by one. The scoop plate is able to be moved between a position in which it somewhat overlaps the top edge of the container in the peel off position and a position retracted therefrom.

12 Claims, 10 Drawing Figures

CONVEYING APPARATUS FOR THE PROCESSING OF PRINTED ITEMS

BACKGROUND OF THE INVENTION

The present invention relates to apparatus for conveying printed items such as newspapers, periodicals and paperbacks and more particularly for individually feeding them from stacks.

Printed products not sold by retailers have to be returned to the wholesaler and individually counted in order to check the refund due to the retailers. This counting of each separate item of printed matter is a tedious, involved operation, not only because of the large number but also because of the variety of differently priced newspapers or the like. To simplify this activity a reading device has been developed which is able to recognise the publications placed thereon on the basis of their title pages after it has been suitably programmed and the images of such pages have been stored in it. The data output from this reader is then automatically processed, this involving operations such as the addition of the prices of the items of printed matter and the crediting of the respective amounts to the separate retailers. However, the need to place every item on the reader separately represents a substantial amount of hand labor causing fatigue and involving high hourly wage rates, since for efficient performance of the operation a large workforce is required.

SHORT SUMMARY OF THE PRESENT INVENTION

Therefore one object of the present invention is to devise a conveying apparatus of the sort in question with whose help mixed items of printed matter may be individually fed automatically and rapidly with satisfactory reliability.

In order to achieve these or other objects which may occur in the course of the present specification, such an apparatus comprises a number of upwardly opening containers for the printed matter, an individual or peel off feeding station into which the containers may be moved so that the said items may be taken from them, each of the containers having a shelf able to slide vertically in the container and being inclined to the vertical at least in the peel off feeding station, a lifting device for each container for cooperation therewith at least while it is in the peel off feeding station for displacing the said shelf, a vertically moving suction device at the top at the peel off feeding station for lifting separate items and a scoop plate placed opposite the suction device for moving under a printed item while lifted by the same, said scoop plate being slanted and adapted to move normally in relation to the axis of the side walls of the container between a position overlapping the top side of the container and a position clear thereof.

The items of printed matter may be stacked in the respective containers in any desired order without paying attention to their size or indeed to any other physical features. It is only necessary to take care to see that the items have their spines on the removal side so that in each case it is the complete item at the top, and not only its first page, that is lifted with the help of the scoop. In each case it is only the uppermost item that is removed and after it has been released from the suction device it moves on the scoop plate of its own accord in a downward direction so that it may be passed on by suitable conveying means to a reading head. These working steps take place completely automatically, reliably and swiftly. The speed of operation may be further enhanced if a number of identical peel off feeding devices are placed side by side of which each has a lifting device, a suction device and a scoop plate. It will be clear that the apparatus in accordance with the invention may not only be used in conjunction with machine reading devices and it may be employed in all those cases involving the peel off feeding of mixed items of printed matter.

A detailed account of the invention will now be given as based on the accompanying drawings.

LIST OF THE SEVERAL VIEWS OF THE DRAWINGS

DETAILED ACCOUNT OF WORKING EXAMPLES OF THE INVENTION

Figure 1:
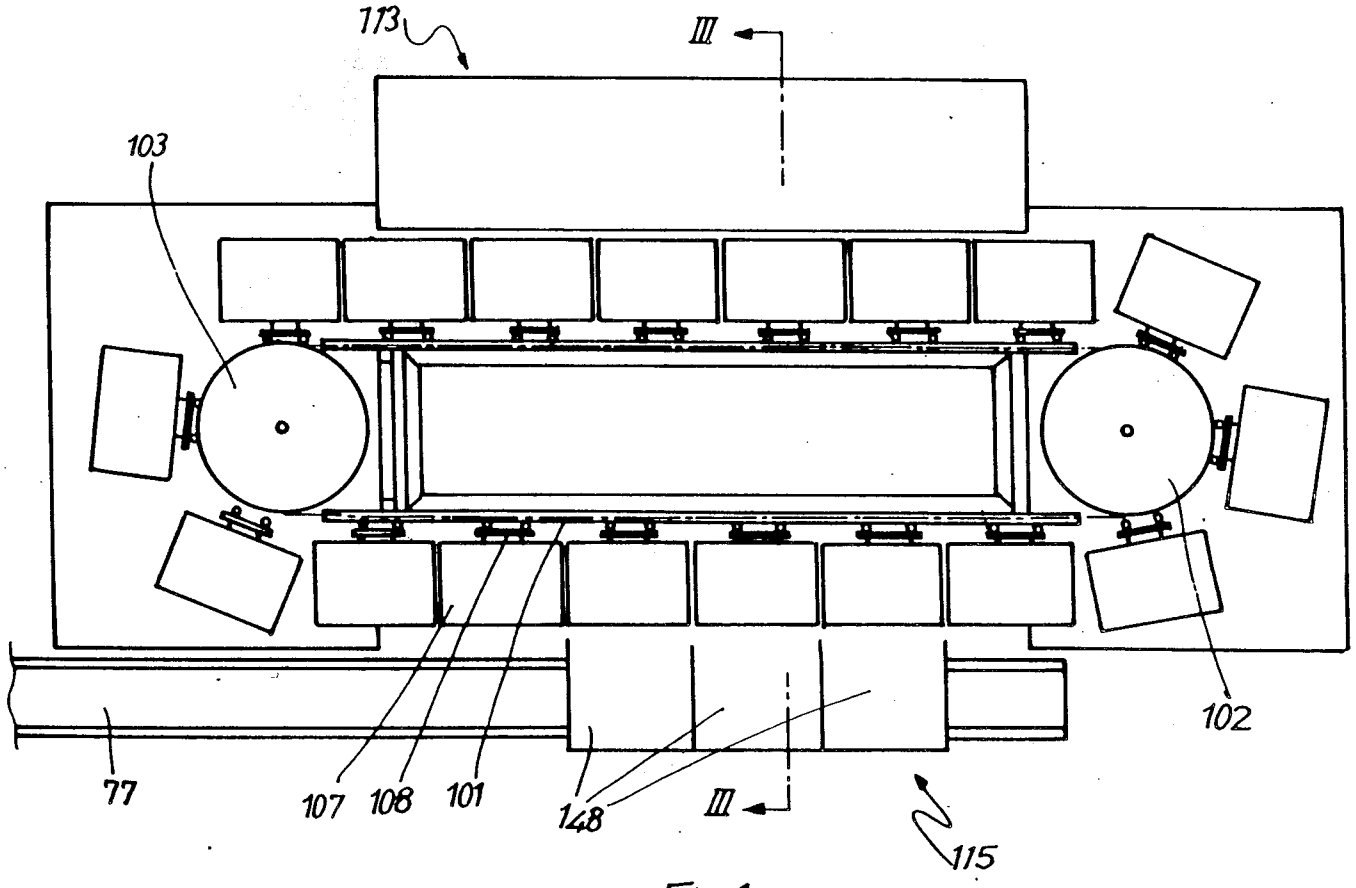
FIG. 1 is a plan view of a first working example of the apparatus in keeping with the invention in a highly diagrammatic form and with some parts omitted to make the figure more straightforward.

It is to be noted as a preliminary that in both the working examples of the invention depicted in the figures, like parts are denoted by like reference numerals so that unless there is any indication to the contrary the following account applies equally for both forms.

Figure 2:
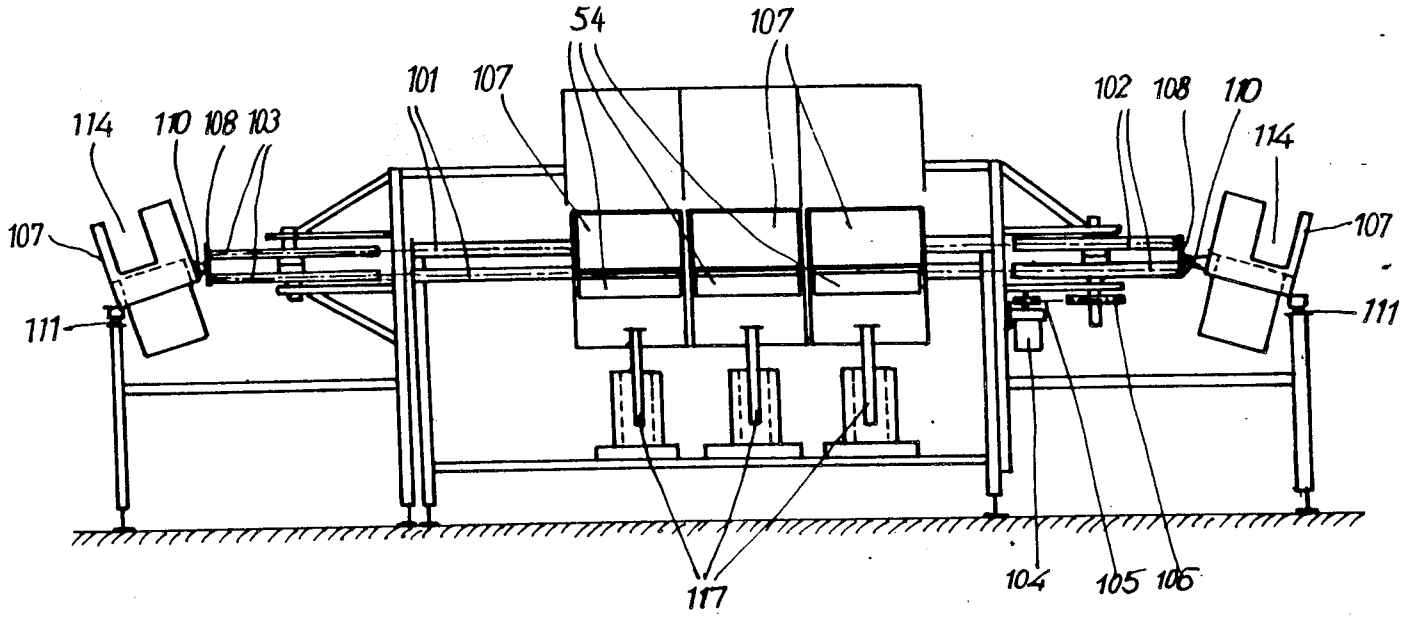
FIG. 2 shows the apparatus from the front.
Figure 3:
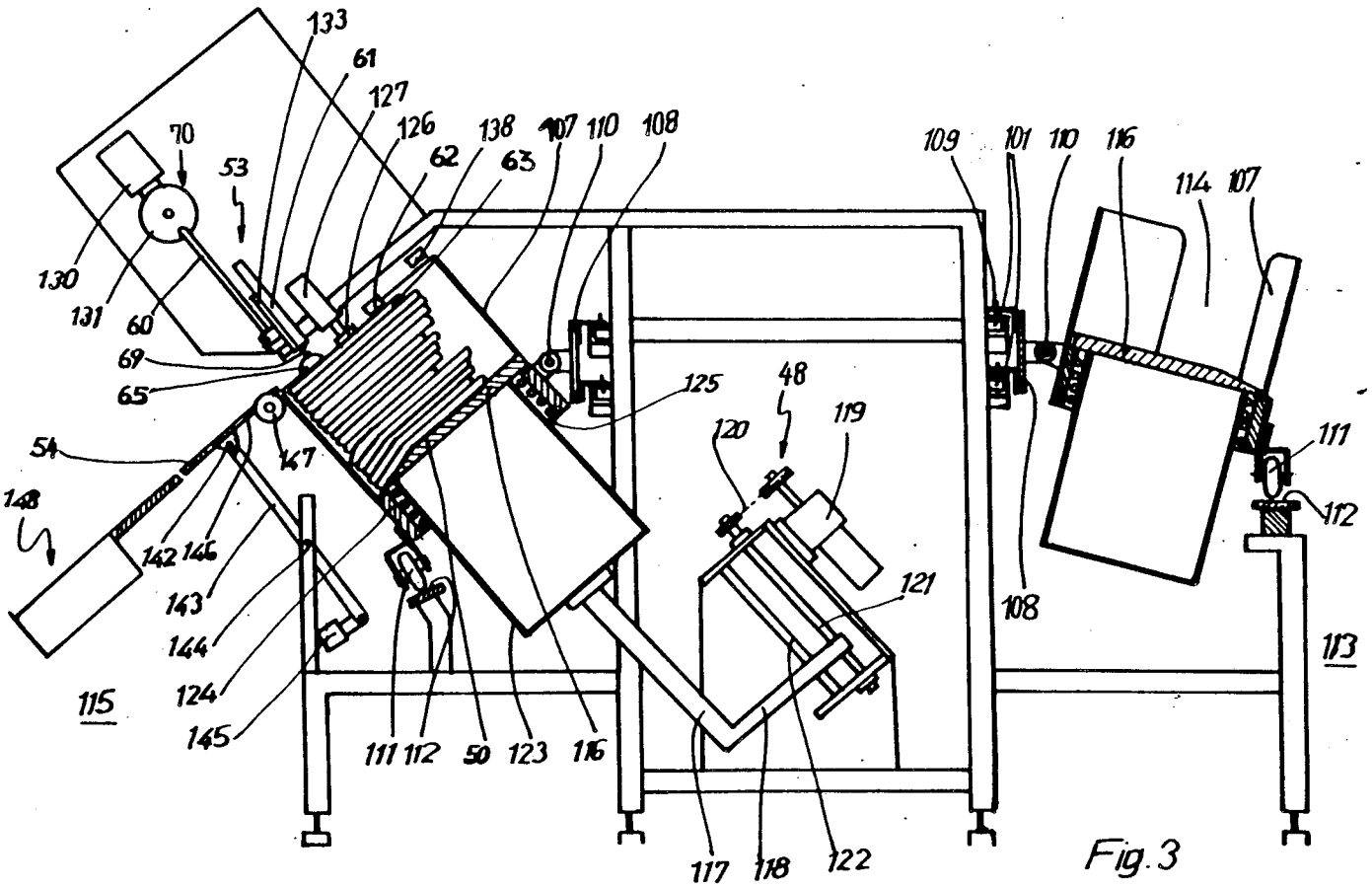
FIG. 3 shows the apparatus of FIGS. 1 and 2 in a cross section taken generally on the line III—III of FIG. 1 with details of the peel off feeding device.

The apparatus to be seen in FIGS. 1 to 3 comprises an endless chain conveyor or the like with two chains 101 placed one over the other and trained around a drive wheel 102 on one end of the apparatus and around a bend wheel 103 at the other end of the apparatus. The drive of the drive wheel 102 is by means of a motor 104 (FIG. 2), a belt 105 driven by it and a pulley 106 mounted on the shaft of the drive wheel (102). The axes of the wheels 102 and 103 are vertical so that the chains 101 run in a level plane. Such chain conveyors or the like may be of known construction so that no further account thereof and of the frame of the apparatus carrying the chain conveyor is required in the present case.

A train of containers 107 for printed items is linked with the chain conveyor, that is to say the conveyor chains 101. Only some of these containers are to be seen in FIG. 2. Each container 107, which is open at the top, has a carrying unit which is supported on both chains 101 and in the present working example of the invention is made up of a support plate 108 and a support bail 109 projecting from the respective chain. These carrying units serve to form a connection between the respective containers 107 and the outer side of the chain conveyor. The containers 107 are so mounted on the respective units that they are able to rock about an axis 110 parallel to the direction of conveying. On their outer side turned away from the chain or like conveyor, herein referred to as the removal side, the containers are supported by rollers 111 on a looped support track 112 placed partly round the chain conveyor like a rail and mounted on the frame of the apparatus. This track is not shown in any detail in FIG. 1. Since the containers 107 are mounted so that they may rock on their support units, the alignment of the containers in relation to the vertical is determined by the changes in height of the support track 112 and it is therefore possible to cause the containers to take on a greater slope in the peel off feeding station than along the rest of the chain conveyor without making the apparatus any more elaborate.

The empty containers 107 are filled with stacked items of printed matter at a loading station 113 (FIG. 1). The order in which the items are stacked is unimportant. As will be described in more detail later, when filling the containers it is only necessary to see that the spines of the items are on the removal side of the containers. To simplify filling of the containers, the sides of the containers at a right angle to the direction of conveying are provided with a vertical slot 114 so that an operator may put his or her arms into the container from the side rather than putting them in through the top (see also FIG. 4).

As will be seen in FIG. 3 the containers 107 are sloped outwards in relation to the vertical by a suitable arrangement of the height of the support track 112 in the loading station, something that also serves to simplify loading.

The apparatus in accordance with the invention furthermore possesses an peel off feeding station 115, to which in the embodiment of FIGS. 1 to 3 the containers are transported by the chain conveyor and in which the items of printed matter are separately removed from the container as same is in such station. The containers are at this position at such a slope towards the removal side that in each case the uppermost printed item when lifted clear of the unit rim may slide off to the outside under its own weight. This is again effected by the level of the support track 112 in this part of the apparatus. As will be gathered from FIG. 4, the containers are placed more obliquely in the peel off feeding station 115 than in the loading station 113, i.e. the supporting track 112 is at a lower level at the peel off feeding station. Between the loading station 113 and the peel off feeding station 115 the containers 107 may be kept at that slope which they had in the loading station (see figure 2), although the arrangement may be different in this regard. The chain conveyors are stationary during loading and empty containers may be filled simultaneously at the loading stations. The chain conveyor makes possible automatic operation at a high speed and it transports the emptied containers quickly back to the loading station.

In order to make FIG. 1 more straightforward, the containers are drawn therein as if they were upright. In FIG. 2 the upper edges of the slanting containers in the peel off feeding station are marked by thickened lines.

At the peel off feeding station 11 there is at least one peel off feeding device. The number of such peel off feeding devices will depend on the number of containers which are to be unloaded simultaneously; in the working example of FIGS. 1 to 3 there are three peel off feeding devices, which are identical in construction. The design and workings of the peel off feeding device will be described later and also in connection with FIGS. 4 to 10, since the peel off feeding devices are similar to those of the present form of the invention.

The working example of the invention to be seen in FIGS. 4 to 9 of the drawings possesses a frame 1, which contains a frame table 2, on which a turning and shifting device 3 is movingly supported. On it container arrangements 5 and 5' each comprising two containers 4 and 4' are mounted. Furthermore the frame 1 on its front side to be seen on the right in FIG. 4 supports the peel off feeding station 115 for peel off feeding of the printed items 7.

A drive shaft 8 is mounted in the frame table 2 so as to be upright and it may be more particularly supported by two radial or radial and thrust bearings 11 or the like on two level superposed struts 9 and 10 of the table. Underneath the upper table strut 10 a gear wheel 12 is keyed on the drive shaft 8, as will more particularly be seen from FIG. 8. The gear wheel 12 meshes with a horizontally aligned rack 13 that is mounted on the frame table 2 so that it may move in the longitudinal direction, and at one (14) of its ends this rack is pivotally joined to a traction rod 15, which in turn is pivotally connected at its end furthest from the rack 13 with an eccentric drive 16 like a connecting rod. The eccentric drive 16 has a drive motor 17. The teeth of the gear wheels 12 and the rack 13 in mesh with each other and the eccentric drive are preferably so chosen that when the drive shaft 18 of the drive motor 17 turns through 180° the drive shaft 8 is also turned through 180°.

The drive shaft 8 extends through the upper table strut 10 and projects beyond its surface. On the projecting end of the drive shaft 8 a support wheel or disk 23 is fixedly mounted, whose plane is at a right angle to the axis of rotation 21 of the drive shaft 8. A window-like rectangular frame 24 is fixed to the top side of the support disk 23, as for example by screw means and the plane of such frame 24 is parallel to the plane of the support disk 23 (see also FIG. 5). The axis of rotation 21 intersects diagonals of the frame 24.

Two guide rods 25 extend in the longitudinal direction over the opening of the frame 24 and are fixed to the two frame members 26 forming the transversal sides, and being respectively joined to the longitudinal frame members 27.

Figure 6:
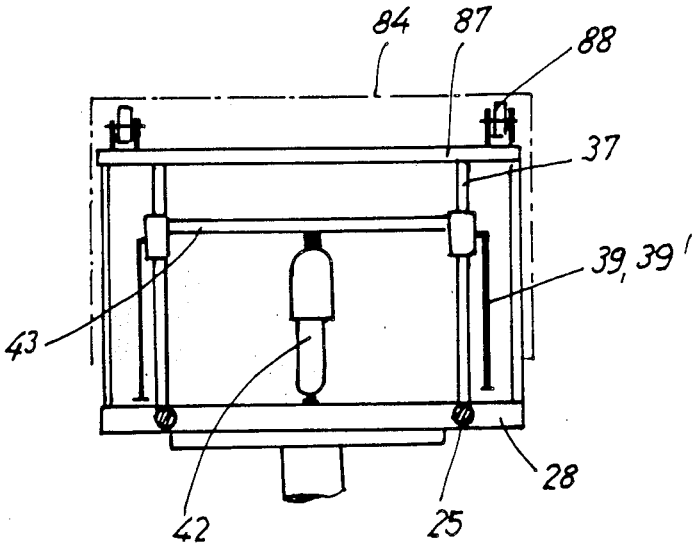
FIG. 6 is a section taken on the line VI—VI of FIG. 4 omitting the frame of the apparatus.

As shown in FIG. 6 there is a middle holding strut 28 extending transversely across the frame 24 so as to connect the two frame members 27. The guide rods 25 extend through the strut 28, same dividing the frame 24 into two frame sections 29 and 29'. Each of these sections has a carriage 30, which is mounted on each of the two sections 29 and 29' of the frame, for sliding in the longitudinal direction using bushes 31. On each of the carriages 30 there is a container arrangement 5 or 5' each having at least one container 4 and 4' for items of printed matter. In the present example of the invention there are two such containers 4 and 4' fixed to each carriage 30. The container arrangements 5 and 5' may on the one hand be turned about the common upright pivot axis 21 and on the other hand may be moved radially in translation in relation to the axis 21. By turning the drive shaft 8 the two container arrangements 5 and 5' may be caused to shuttle between the peel off feeding station 115 and a loading station 113 also present in the arrangement.

Figure 4:
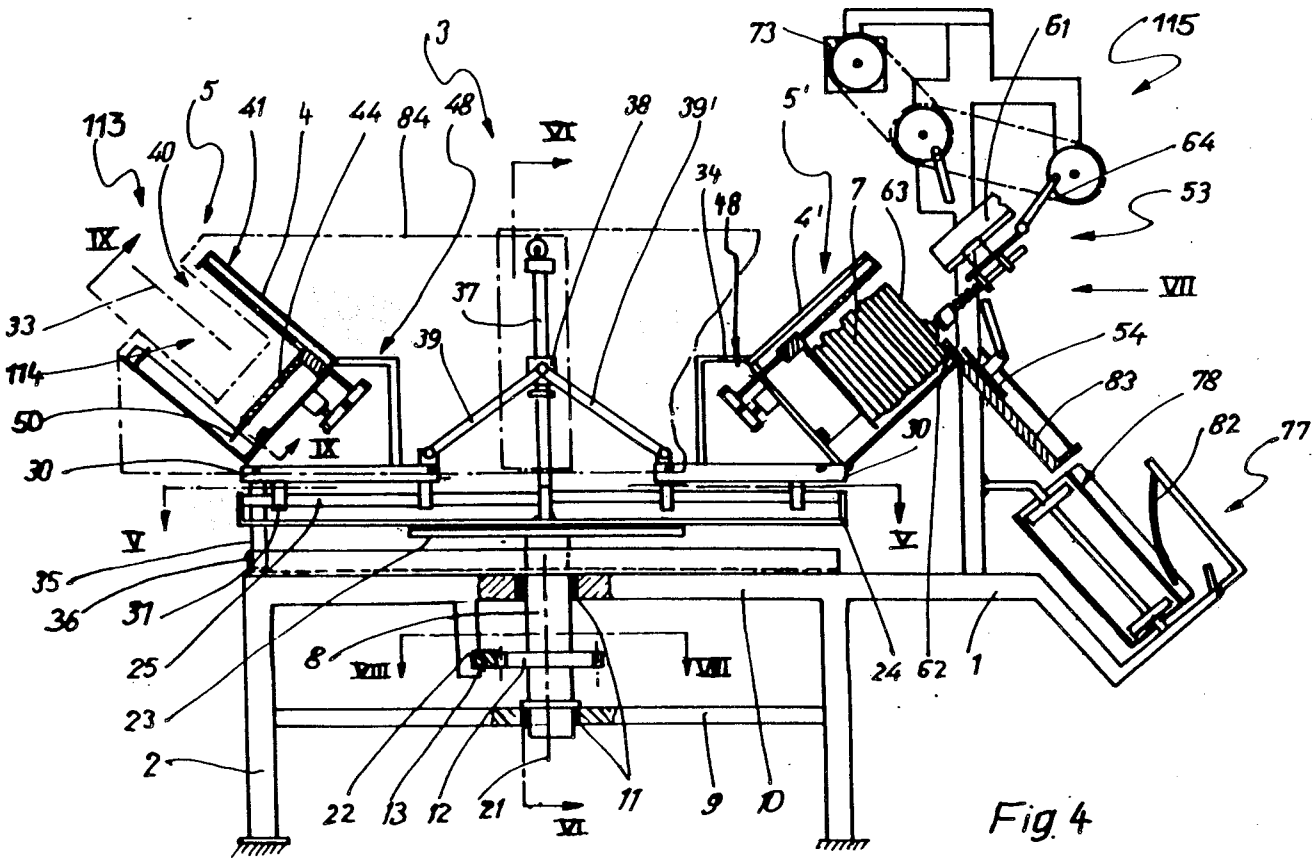
FIG. 4 shows a further embodiment of the apparatus in keeping with the invention and with parts cut away.
Figure 5:
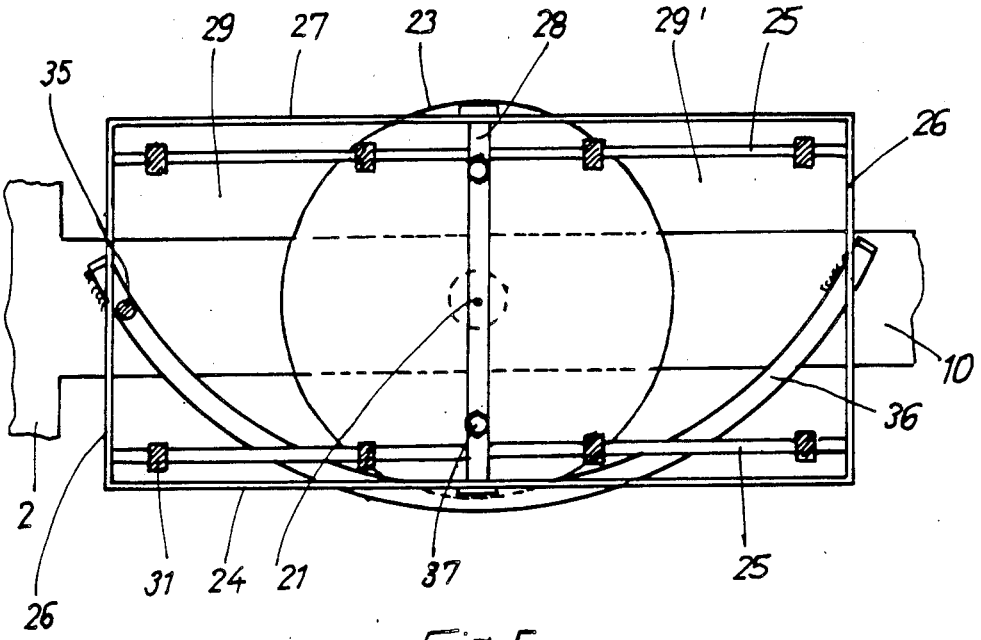
FIG. 5 is s section taken on the line V—V of FIG. 4 looking in a downward direction.

As shown in FIG. 4, the peel off feeding station 115 and the loading station 113 are placed horizontally opposite each other, the container arrangements 5 and 5' being located between the two stations 115 and 113. It is an advantage if one of the container arrangements is in the loading station 113 while at the same time the other of the container arrangements is in the peel off feeding station 115 so that the speed of operation of the apparatus is very high.

Like the containers 107 as already described, the containers 4 and 4' are open at their top ends and so mounted on the carriage 30 that the top end 40 is directed somewhat to the side, i.e. at a slant. The axis 33 aligned with the end walls of the containers 4 and 4' is therefore on a slope in relation to the vertical and makes an acute angle with the axis 21 of rotation. Actually this position, as described of the container arrangements only has to be assumed by the container arrangements when they are in the peel off feeding station in order to ensure that the top end 40 is here inclined towards the removal side. However in order to make the design simple and reliable in operation while at the same time having a low wear rate, the container arrangements 5 and 5' are fixedly mounted on the respective carriages 30 so that the containers 4 and 4' are sloped outwards in the loading station as well and more particularly while shuttling between the two stations 113 and 115. 34 denotes a holder for the slanting containers.

A guide pin 35 is mounted on the lower side of one of the carriages 30 to act as a follower cooperating with a cam 36 (see also FIG. 5) mounted on the top side of the frame table 2. The cam 36 is in the form of a channel whose two sides act on the follower pin 35. The cam has the form of a bow so placed that the end parts of the cam are generally at the middle of the transverse frame members 26 while the point of inflexion of the cam 36 is on member 27. The cam 36 is placed symmetrically in relation to the axis of rotation 21, the distance between the axis of rotation and one the guide parts being in each case larger than the distance between the axis of rotation and the end of the guide. For this reason when the frame 24 is turned about the axis 21 of rotation the carriage 30 attached to the follower pin 35 will simultaneously perform a translatory movement in the longitudinal direction of the frame 24. In a position in which the two container arrangements 5 and 5' are respectively at one of the stations 113 and 115, the follower pin 35 will be at an end part of the cam so that on rotation of the drive shaft 8 it will firstly move radially inwards to an increasing extent and then move outwards again in relation to the axis 21.

In order to participate in the translatory motion of the cam-driven carriage, the carriage 30 without any follower pin is coupled with the latter. For this purpose the holding strut 28 has two spaced upright guides 37 attached to it and there is a guide shoe 38 for cooperation with each of the guides 37 by moving in the longitudinal direction thereof. Two links 39 and 39' are respectively attached to each of the guide shoes 38, such links being in addition pivotally attached to the first carriage 30 and the second carriage 30 respectively. If now the carriage 30 attached to the follower pin 35 is forced to shift in an inward direction by the cam 36 (when rotation takes place) the guide shoes 38 will be moved upwards with a transfer of motion by way of the links 39 running on the upright guides 37 so that the second carriage 30 attached on the links 39' will shift inwards also. When motion has extended past the end of the point of inflexion of the cam 36 the two container arrangements 5 and 5' will move away from each other again and after turning through 180° will be in their end positions. In every position of the container arrangements the links 39 and 39' constitute the equal sides of an isosceles triangle. By reducing the radial distance between the containers it is possible for the apparatus to be made with a small overall size.

In order to prevent any irregular rocking of the container arrangements 5 and 5' in their end positions, their shift motion is damped by way of a respective damping element 42 (see FIG. 6) which is placed between the holding strut 28 and one of the two guide shoes 38.

The containers 107 or 4 and 4' of the two examples of the invention described herein are generally identical in construction. In this respect the important point in connection with the separate removal of the items of printed matter from the top end of the respective container is that each printed matter container 107 or 4 and 4' has a vertically moving shelf; the ensuing description will be focussed on two possible designs of the shelf arrangement.

In the working example of the invention of FIGS. 1 to 3 there is a lifting device 48, mounted on the frame of the apparatus, at the peel off feeding station. When a container moves into the peel off feeding station the lifting device engages the shelf 116 of the container 107 in the peel off feeding station and moves it upwards in steps, the size of each such step generally being the same as the thickness of the respective item of printed matter that happens to be at the top of the stack. The lifting device comprises a lifting rod 117 extending in the vertical direction of the container and such rod is joined by way of a transverse arm 118 with a screw threaded rod 121 driven by way of a motor 119 and a belt drive 120. It is guided for motion parallel hereto by a guide rod 122. Dependent on the respective direction of rotation of the motor 119 the lifting rod 117 will be moved upwards or downwards, and with it the container shelf 116.

The lifting rod 117 does not directly engage the shelf 116 of the container but indirectly by way of a guide neck 123 mounted in the lower side of the container shelf. This neck 123 runs on the wall of the container 107 or a bearing part joined fixedly thereto. In the present working example of the invention there is a bearer frame 124, placed so as to extend round the lower end part of the container wall to act as a support and which at the top forms a stop for the container shelf 116 so that it is not possible for the latter to drop out of the container and on its inner edge the guide neck 123 is in the form of a box-like hollow body. The container shelf constitutes a sort of cover, projecting at its outer edge, for the box-like neck 123, whose lower side is engaged by the lifting rod 117. The container shelf is therefore supported over a large area and this ensures that there is no chance of its running skew. Such guiding effect is particularly efficient and freely running if there is an anti-friction bearing 125 located between the support part (bearer frame 124) and the guide neck 123.

Figure 9:
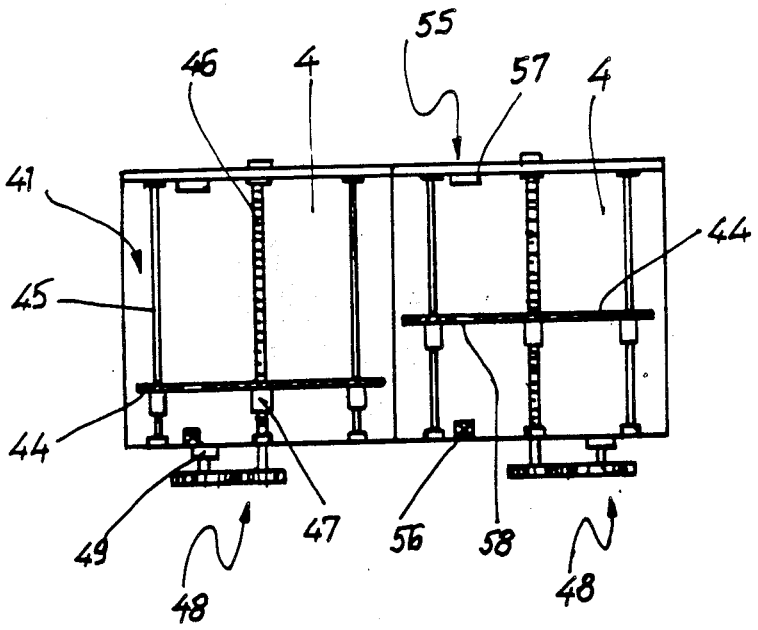
FIG. 9 is a section of the container arrangement taken on the line IX—IX of FIG. 4.

On the other hand in the working example of FIGS. 4 to 9, each of the container shelves 44 of the respective container 4 and 4' has a lifting device 48 (see in particular FIG. 9). The shelves 44 are mounted on guide columns 45 for longitudinal translatory movement. These columns 45 run in the vertical direction on the respective container 4 and 4' and are placed next to the side wall 41 thereof which is uppermost. Parallel to the guide columns 45 there is a screw threaded rod 46 which is bearinged on the container and runs through the respective shelf 44 to engage a lead nut 47 thereon. The lead nut 47 and the screw threaded rod 46 form parts of the lifting device 48, which also comprises a drive motor 49 mounted on each respective container and which drives the screw threaded rod 46 by way of gearing. By turning the screw threaded rod 46 it is possible for the shelf 44 to be raised or lowered.

To facilitate filling, the containers 4 and 4' are provided with side slots 114 as noted.

Owing to the separate provision of the container shelf 44 and the device 48 on each container 4 and 4' of the container arrangements it is possible for the shelves 44 to be raised or lowered whatever the positions in which the containers happen to be, such vertical motion being more particularly carried out during rotation of the container arrangements, something that leads to a substantial saving in time. The operation of the lifting devices 48 takes place automatically and is controlled by a sensor device 55, which in the working example of FIGS. 4 to 9 operates photoelectrically. Accordingly in FIG. 9 there is a light source 56 placed under each container shelf 44 and there is a reflector 57 opposite it on the top side of the container. In the container shelf 44 there is an opening 58 in the light path from the light source 56 so as to make possible passage of the light therethrough. The drive motor 49 of the lifting device 48 is so connected with the sensor device 55 that when the light path between the light source 56 and the reflector 57 is not obscured, i.e. when the container is empty and directly after the removal of the last item of printed matter therefrom, the container shelf 44 is lowered into its lowermost position. If the opening 58 is covered over because the container is more or less full of printed matter, the light path will be interrupted and there will be a change in the direction of rotation of the drive motor 49 so that the shelf 44 will be moved towards the top end 40 of the container. It will be seen from FIG. 4 that there is a limit switch 62 in the vicinity of the top of every container so that when the uppermost (63) item of the stack of printed matter 7 has reached the switch, the drive 49 of the lifting device 48 will be turned off. If now this uppermost item 63 is removed, the shelf 44 will be again moved a further step upwards until the next item actuates the limit switch 62. On removing separate printed items from the containers 4' there is therefore a stepped upward motion of the container shelves as far as the top end 40 of the respective container.

The working example to be seen in FIGS. 1 to 3 also has a limit switch 62 of the type described. However, since in this case there is no sensor device 55, there is an end of lift limit switch 138, which is actuated by the container shelf 116 after complete removal of the printed items and then reverses the motor 119 of the lifting device, so that the container shelf 116 is automatically lowered as far as it will go.

Figure 7:
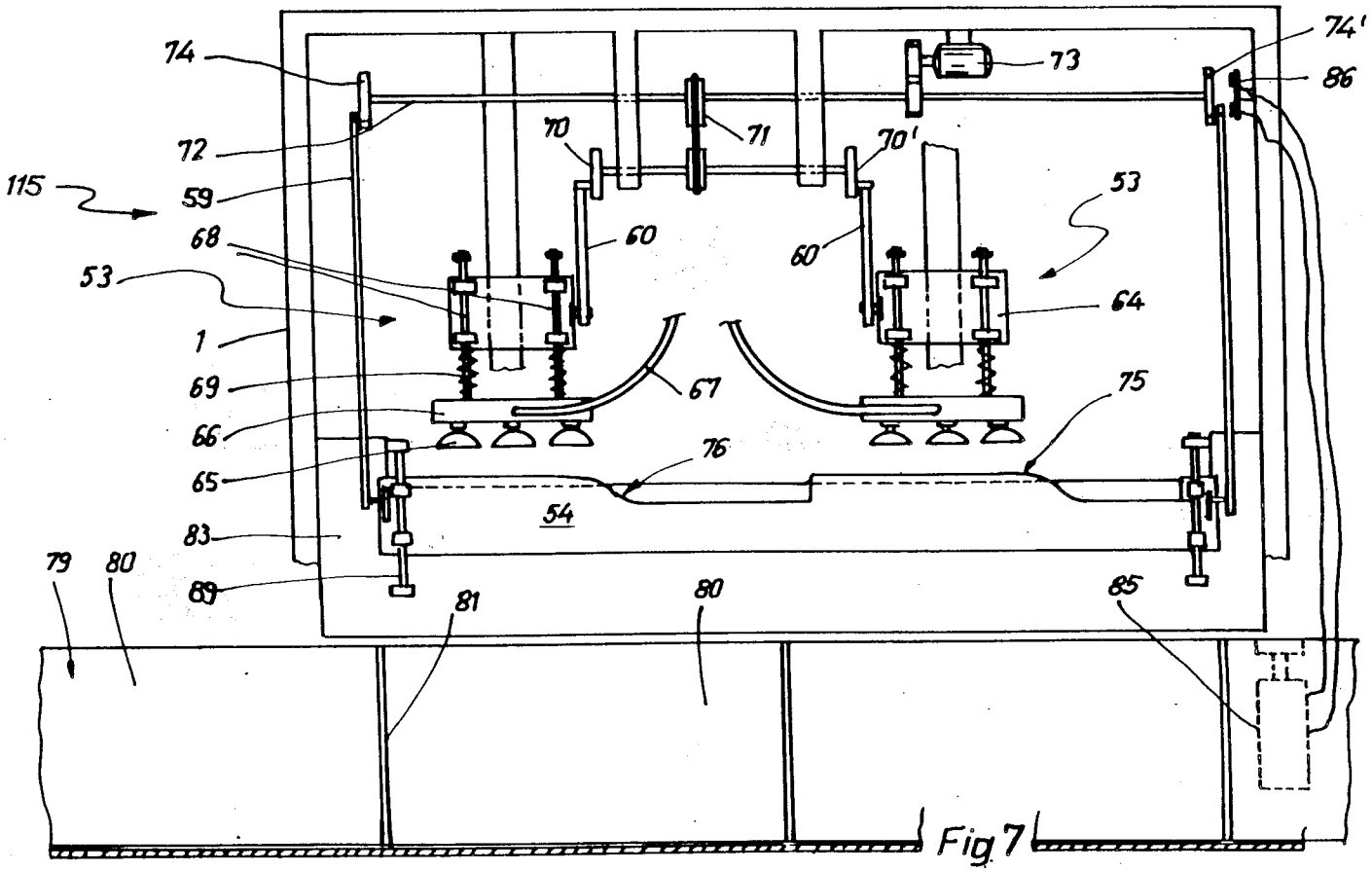
FIG. 7 is a front view looking in the direction of the arrow VII of FIG. 4 to show the main parts of the apparatus.
Figure 8:
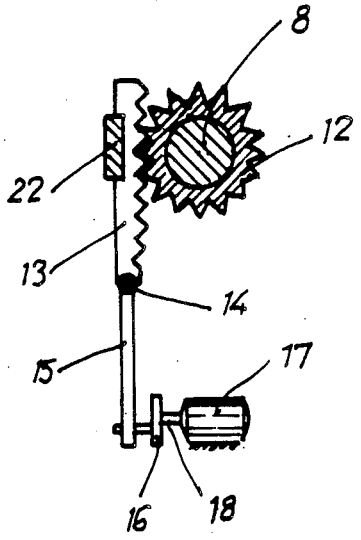
FIG. 8 is a section of the drive unit of the apparatus taken on the section line VIII—VIII of FIG. 4.

In the peel off feeding station 115 each printed matter container 4' and 107 cooperates with a suction device 53, able to move in the vertical direction in relation to the container, and on the outer side, that is to say in the vicinity of the container there is an opposite slanting scoop plate 54 (see FIG. 3, 4 and 7). This plate is able to be moved in a direction generally parallel to the top side of the container 4 and 4' over its top edge (see figure 3) backwards and forwrads and normally to the axis of the side walls of the container between a position somewhat overlapping the top side 40 of the container and a position uncovering the top side 40, and if desired (see figure 3) it may be mounted for free pivoting motion to make possible an adaptation to the form of the lower pages of the printed items at a right angle to the direction of removal.

Figure 10:
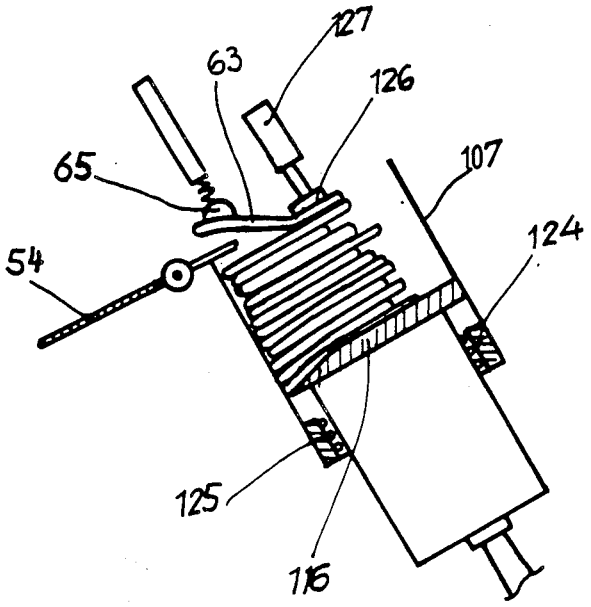
FIG. 10 is a diagrammatic view of an peel off feeding device in order to explain its manner of operation

In the embodiment of the invention of FIGS. 1 to 3 the suction device 53 comprises but one suction head as compared with three such heads 65 in the case of the embodiment of FIGS. 4 to 9. Once a suction head 65 has engaged the uppermost item of printed matter and at the same time has been connected with a source of vacuum which is not shown, it will shift the edge of the adjacent item in an upward direction with it as it moves upwards as is shown in FIG. 10. But cutting off the vacuum at the suction device or at the suction heads 65 the item will be released again. Care is to be taken to see that the spines of the items are on the removal side of the container so that the suction head 65 (acting conjointly with the scoop plate 54) will lift the entire respective item of printed matter and not just its top page.

As will be seen from FIGS. 3 and 7 the suction heads 65 are mounted by means of springs 69 so that their lower sides that engage the upper faces of the printed items will align themselves in relation to such sides and there may also be an adaptation to allow for the thickness of the printed items. As will be seen from FIG. 7 the suction heads are preferably mounted on a pneumatic supply line 67 to provide a connection with a vacuum producing apparatus, not shown. If the line 67 is exhausted, the suction heads 65 will produce a sucking effect. The rail 66 is shiftingly mounted on a guide carriage 64 by way of plungers and springs 69 for damping the extent of relative displacement. An articulating attachment means would also be possible as shown in FIG. 3.

The suction device 53 is mounted on a driving rod 133 (FIG. 3) or on a guide carriage 64 (FIG. 7), which runs on a longitudinal guide 61 joined with the frame 1 and extending in the vertical direction on the container 4'. On the rod 133 or the carriage 64 a driving rod 60 is pivoted, which is coupled with an eccentric element 131 of an eccentric drive 70, for producing a reciprocating motion.

The working example of the apparatus of the invention shown in FIG. 4 possesses two parallel suction devices 53 at the peel off feeding station, which are identical in form, and a scoop plate 54 which is common to the two suction devices and which is slidingly mounted by way of guide devices 89 joined with the frame 1. The two suction devices 53 are moved in step since the two guide carriages 64 are coupled with eccentric drives 70 and 70' (which are rotatingly linked together) by means of two drive rods 60. The eccentric drives 70 and 70' are driven by way of a chain drive 71 or the like, whose driving wheel is mounted in a driving shaft 72. This shaft is able to be driven by a drive motor 73 and it additionally possesses two eccentric drives 74 and 74', which cause reciprocation of the scoop plate by way of suitable thrust rods 59; the motion of the suction devices 53 and of the scoop plate 54 is therefore positively coupled in order to be certain of reliable operation.

In contrast to this in the embodiment of the invention of FIGS. 1 to 3, the suction device 53 and the scoop plate 54 are driven separately from each other. The drive of the eccentric driver 70 is by way of a motor 130 while the scoop plate 54 is driven by way of a rocking drive 145, which has a pivoting arm 143 rockingly mounted on the apparatus frame at 144. The arm 143 forms a holder for the scoop plate 54. In this respect it is furthermore possible to have a downwardly acting retainer 126 in the peel off station 115 over the respective container. In the present example of the invention this retainer is simply in the form of the piston rod of an actuator cylinder 125 whose cylinder is attached to the apparatus frame. The retainer 126 is able to be moved vertically in relation to the container so that in its lower position it presses against the uppermost item in the stack and holds it down, whereas in its raised position it will release such printed item. To make the drawing more straightforward the compressed air supply to the actuator cylinder 127 is not shown.

ACCOUNT OF OPERATION OF INVENTION

An account will now be given, more particularly on the basis of figure 10, of the workings of the peel off device in both its possible forms described herein.

At the start of each peel off cycle, the container shelf 44 or 116 is moved upwards until the respective top item 63 of printed matter is aligned with the top of the container. By means of the limit switch 62 the lifting device is switched off. The retainer 126 (if present) and the suction device 53 move downwards, the retainer 126 pressing on the item 63. The suction head 65 acts on the item 63. Then the suction head 65 with the edge of the item adhering thereto moves upwards till the edge part projects up past the scoop plate 54. At this juncture the retainer 126 (if present) will still be holding the part of the item 63, remote from the spine, down in order to keep it in position. Then the scoop plate 54 is moved into its advanced position in which it fits under the edge part of the item. Following this the retainer 126 is moved upward so that it releases the printed item. After venting the suction head or heads 65 the item is released and slides under the effect of gravity down the scoop plate 54 in the removal direction. At the same time or subsequently the scoop plate 54 is moved into its position (shown in FIGS. 3 and 4) clear of the top of the container. A new cycle then starts, i.e. the container shelf 44 or 116 is moved upwards through a distance equal to the thickness of the next printed item and so on. As indicated, the downardly acting retainer is not absolutely essential.

While the containers 107 or 4' are in the process of being unloaded in the peel off station 115, it is possible to save time by simultaneously loading containers 107 or 4 in the loading station. It is more especially the form of the apparatus described with reference to FIGS. 4 to 9 that has a high level of efficiency in this respect as will be seen from the special form of conveying motion of the container arrangements 5 and 5'.

After the containers 4 standing in the loading station 113 are filled (with the shelf 44 in the lowered position), the container arrangements 5 and 5' are turned through 180° by the rack 13. During such turning the container shelf 44 is moved so far upwards owing to the opening 58 being covered that the uppermost printed item 63 actuates the limit switch 62. During the course of the swiveling motion the two container arrangements 5 and 5' are firstly moved towards each other and then away from each other because of the action of the cam on one of the carriages 30, this being to prevent the container 4' from striking against the scoop plate 54 while nevertheless positioning the container directly adjacent to the scoop plate 54 in its terminal position. Once the container arrangement 4' located in the peel off station 115 has been unloaded, the container arrangements are turned back into their starting position, the shelf of the emptied container 4' being moved downwards owing to the opening 58 even while the swiveling is taking place. The entire operation is then repeated.

In order to make it possible for the scoop plate to be moved neatly under printed items that are not tidily stacked, the plate has an oblique form of edge along a portion 76 of its length at least on its side 75 adjacent the container arrangements. When being moved under the printed items this oblique edge is eased gently into position in order to avoid malfunction.

Bound printed items are generally thicker at the spine than at the side opposite thereto. If no additional features were provided such spines would therefore cause the stack to be higher on the removal side of the container and the spine side of the stack would then project out of the top of the container. In order to avoid this, the container shelf 44 or 116 is slanted downwards towards the removal side of the container. The wedge-like, downwardly slanting part of the shelf to be seen in FIGS. 3 and 4 is denoted by reference numeral 50. The effect is that the stacked printed items are now generally leveled off.

In order to promote sliding motion of the printed items the scoop plate 54 may have recesses 146 as shown in FIG. 3 in which driving rollers 147 are placed so that their tops are level with the upper face of the plate 54 and when the rollers are driven they will move the items in the desired removal direction. The rollers 147 are preferably bearinged in the scoop plate.

At the removal side of the peel off station 115 there is a slanting conveyor device 77 in the form of a conveyor belt placed so that its plane of conveyance 78 is transverse in relation to the axis of the side walls of the container 4' or 107 located in the peel off station. The unstacked printed and bound items slide down into this conveyor one by one and are removed thereby. The conveying path or the conveyor belt 79 of the conveying device 77 is subdivided into separate conveying sections 80 by means of separating ribs 81 so that the printed items are neatly separated from each other when being carried away. In the part under the scoop plate 54 it is possible to have a baffle cloth 82 as shown in FIG. 4 in order to prevent printed items sliding off the conveying sections 80 unintentionally.

The unstacked printed and bound items are moved by the conveying device 77 past a reader head that is not shown in FIGS. 4 and 7, or in the arrangement of FIG. 1, they are carried away after passing a reader head 148 placed under the peel off station.

As will be seen from FIGS. 4 and 7, the scoop plate 54 is slidingly mounted on a guide plate 83 which extends parrallel to the plane of the scoop plate and is stationarily mounted on the frame 1 between the container arrangement located in the peel off station 115 and the conveying device 77. The guide plate is adjacent to the top side of the containers and of the conveying path 79 of the conveying device. The said guide plate constitutes a connection between the scoop plate and the conveying device. The motion of the conveying device 77 is timed to match that of the suction device. The conveying path of the conveying device moves in step with the motion of the suction devices in a forward direction in order to guarantee a satisfactory sliding down of the unstacked printed items onto the separate conveyor sections 80. The drive of the conveying device is by way of a drive motor 85 that is marked in broken lines in FIG. 7 and which is controlled by sensors 86 (more especially in the form of inductive pick-ups) placed in the vicinity of one of the eccentric drives 74' to respond to the angular setting thereof.

As a protection against dirt and dust the two container arrangements 4 and 4' are furnished with a cover 84 extending over parts thereof, that is to say not covering the top sides 40 and the slot openings 114 (see FIGS. 4 and 6 where the cover is marked in broken lines). The cover has two parts, which are respectively applied to one of the two container arrangements 4 and 4'. The two parts are able to be slid over each other in the direction of sliding of the container arrangements. In order to reduce friction it will be seen from FIG. 6 that the vertical guides 37 have their top ends joined by a horizontal strut 87 with upwardly acting support rollers 88 on its two ends to take the weight of the cover 84, marked in broken lines, and to allow it to be shifted.

By way of conclusion it may be said that the essential advantage of the apparatus in accordance with the invention is its high speed of operation and its reliability. It is more especially the use of more than one container that makes it possible for one of the containers to be emptied in the peel off station while in the meantime other containers are able to be loaded. The peel off or dispensing of the printed and bound items may therefore be undertaken quasi-continuously and it is only on changing from the loading to the peel off station that there is a short interruption in the peel off operation. There is therefore the advantage that the peel off of the printed items takes place automatically at a very fast rate. Furthermore, only one operator is called for to run the apparatus of the invention, that is to say for loading the containers at the loading station; accordingly the labor and other operating costs of the apparatus are extremely low. The efficiency of the apparatus in keeping with the invention is enhanced still further by having more than one container in each container arrangement so that a number of stacks of printed items may be unstacked at the same time. A further great increase in the speed of operation is produced by equipping each container with its own moving and separately driven shelf since in this case the container arrangement will be completely discharged in the peel off station, the shelves of the containers of the arrangement being in the lifted position at the same time so that a container may be moved between the peel off and loading stations without having to await downward movement of the shelves. The downward motion of the shelves may take place in the loading station for example, while the other container arrangement is in the peel off station.

I claim:

1. In a device for separating stacked objects, particularly flat objects such as bound publications having a binding or spine along one portion thereof, using a plurality of receptacle-like object holders that move between a loading station and a separating station, an arrangement including means defining a generally vertical rotational axis such that the loading station and separating station are locating at opposing positions relative to said axis, means including at least two opposing receptacle-like object holders cooperatively arranged to be capable of a relative rotational movement around said axis alternately between the loading station and the separating station whereby at a given point one of said holders is in the separating station at the same time that the other said holder is in the loading station, and further to be capable while undergoing such rotational movement and/or while changing stations of also executing a relative radial sliding motion with respect to said axis in the course of which said opposing holders first move toward one another and then away from one another, each said holder having a holder floor on which the objects can be placed in stacked form and also having a removal side, a floor lifting device associated with each said holder which moves in coordination with a change of station for the graduated raising and lowering of the respective holder floor, a suction device above a corresponding said holder whenever said holder is in the separating station and which suction device moves up and down for removing the top object on the stack thereat at any given time, and an inclined slide plate on the removal side of said holder whenever said holder is in the separating station, the holder floors of said holders at least during the time they are in the separating station being inclined from the vertical towards the removal side and towards said slide plate, and the lifting devices associated with respective ones of said holder floors being separated therefrom and arranged for actuating independently of one another and independently of the position of the associated holder at any given time, whereby said holders can be completely unloaded each time they are in the separating station.

2. Device pursuant to claim 1, characterized in that said object holders are inclined towards the removal side at the top both in the separating station and in the loading station and also and especially during the change of station.

3. Device pursuant to claim 1, wherein each object holder is subdivided into several receptacle-like holder sections and has several and particularly two holder floors situated next to each other and each equipped with a separate lifting device.

4. Device pursuant to claim 1, wherein the object holders are coupled in their sliding movement preferably by means of a joint rod arrangement where at least one of the object holders is guided by a stationary and preferably arc-shaped curving guide that constrains its radial movement in such a way that the two object holders, during a change of position with respect to the stations, first lessen the interval between them and after completion of the position change again assume their original, greater distance from each other.

5. Device pursuant to claim 1, wherein the holder floor on the removal side of the object holder is inclined downward towards that side.

6. Device pursuant to claim 1, wherein the slide plate is movable back and forth transversely to the direction of lift of the holder floor at that moment in the separating station between a position advanced over the upper side of the holder and hence at first travelling partway under the object raised by the suction device and a position releasing the upper side of the holder.

7. Device pursuant to claim 1, wherein in the separating station above the object holder is positioned a pressing device, movable up and down, for holding down the portion of the top object away from the binding when that object is suctioned off by the suction device possessing at least one preferably spring-mounted suction head.

8. Device pursuant to claim 1, wherein on each object holder or on the separating station in the area of the topside of the holder is mounted an end switch that shuts down the drive of the associated lifting device when the top publication reaches removal position.

9. Device pursuant to claim 1, wherein each object holder has an optical sensing device in the form of a light barrier, that brings about a lowering of the floor when the holder is empty and a raising of the floor when there is at least one object in the holder, whereby it is suitable to have a transmitter positioned underneath the floor, a receiver located opposite it on the upper side of the holder and an opening lying between them through the floor of the holder.

10. Device pursuant to claim 1, wherein on the separating station in the area of the top side of the holder a lift end switch is positioned that is activated by the holder floor after the holder is completely emptied and thereby switches over the drive of the lift device to completely lower the holder floor.

11. Device pursuant to claim 1, wherein said slide plate on the side of it that is toward the holder in the separating station has a slanted edge gradient on at least a portion of its length measured transverse to its movement.

12. Device pursuant to claim 1, wherein on the removal side of the separating station is positioned a conveyor belt, inclined with its conveyor plane preferably transverse to the up-and-down direction of the holders for carrying away the separated objects, of which the conveyor track is preferably divided lengthwise into conveyor sections to receive the separated objects.

* * * * *